United States Patent [19]

Smith

[11] 3,964,408

[45] June 22, 1976

[54] PATTERNING DEVICE FOR TUFTING MACHINES OR THE LIKE

[75] Inventor: Randel P. Smith, Chattanooga, Tenn.

[73] Assignee: The Singer Company, New York, N.Y.

[22] Filed: Oct. 8, 1975

[21] Appl. No.: 620,526

[52] U.S. Cl. ..... 112/79 A
[51] Int. Cl.[2] ..... D05C 15/26
[58] Field of Search ..... 112/79 R, 79 A, 79 FF, 112/78, 203, 86, 90, 102

[56] References Cited

UNITED STATES PATENTS

| | | | |
|---|---|---|---|
| 3,100,465 | 8/1963 | Broadrick | 112/79 R |
| 3,301,205 | 1/1967 | Card | 112/79 A |
| 3,511,976 | 5/1970 | Nidenberg et al. | 112/79 A |
| 3,895,355 | 7/1975 | Shorrock | 112/79 A |

*Primary Examiner*—H. Hampton Hunter
*Attorney, Agent, or Firm*—Edward L. Bell; Robert E. Smith; Alan Ruderman

[57] ABSTRACT

A patterning device for a tufting machine including a rotary shaft carrying three cams and driven in timed relationship with the tufting machine. Two of the cams each act to cyclically oscillate a respective pawl carrying carriage in opposite directions toward and away from the other during a substantial portion of each cycle. Two sets of ratchet teeth one for each pawl are secured to an output drive member which may be coupled to a tufting machine fabric or needle bar shifting system. A programmable pattern controller drive in synchronization with the shaft selectively controls the engagement of the pawls with the respective set of ratchet teeth during a portion of the cycle when each carrier is moving in a first non-coupling direction and when the directions reverse motion is transmitted to the ratchet by the engaged pawl. The third cam controls a locking tooth to cyclically engage with and disengage from a set of teeth in a locking and alignment plate secured to the output drive member. The locking tooth is engaged during a major portion of every cycle and controllably releases the output drive member only during that portion of the cycle in which the pawl carriers are moving in the motion transmitting direction.

21 Claims, 8 Drawing Figures

Fig. 3
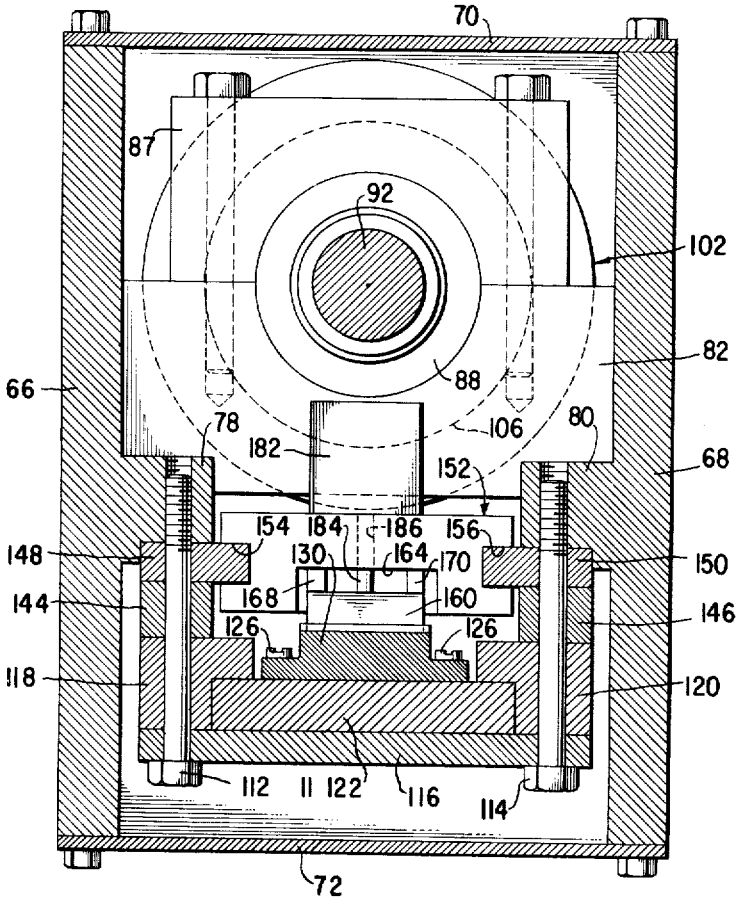
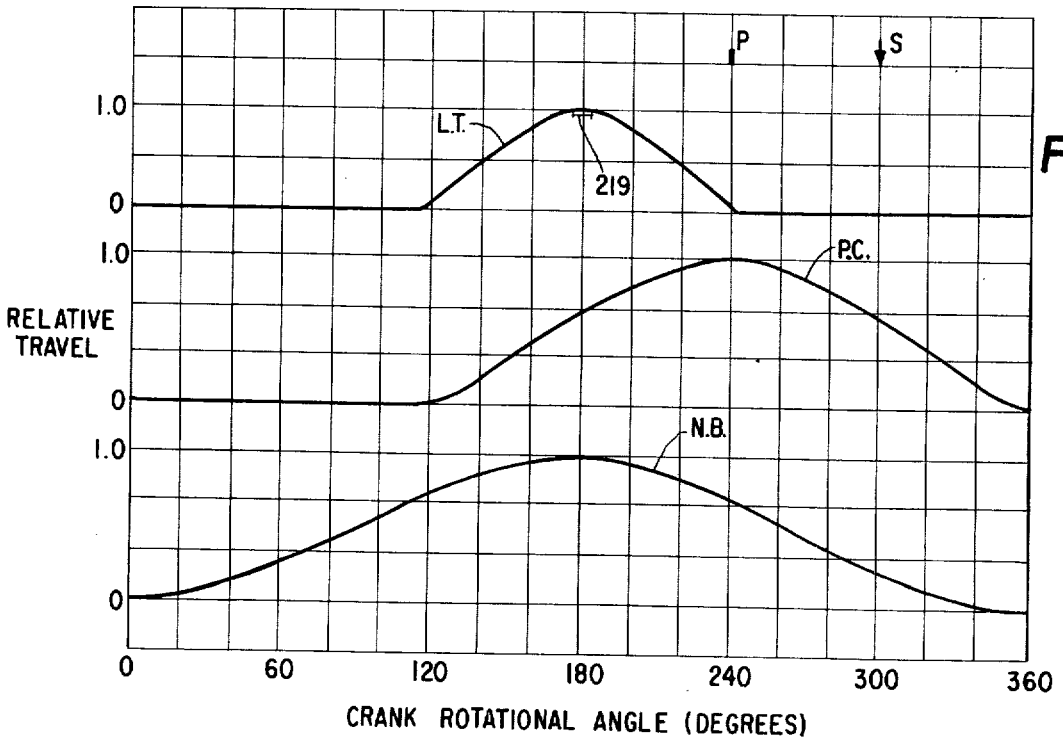
Fig. 7

PATTERNING DEVICE FOR TUFTING MACHINES OR THE LIKE

BACKGROUND OF THE INVENTION

This invention relates to tufting machines and more particularly to a new and improved patterning device for shifting the individual yarn ends laterally between the longitudinal rows of pile formed by the tufting machine.

The art of tufting incorperates a plurality of yarn carrying spaced needles extending transversely across the machine and reciprocated cyclically to penetrate and insert pile into a backing fabric fed longitudinally beneath the needles. During each penetration of the backing fabric a row of pile is produced transversely across the backing. Successive penetrations result in a longitudinal row of pile produced by each needle. This basic method of tufting limits the aesthetic appearance of tufted carpet so produced.

Methods have been devised which effect relative shifting between the needles and the backing fabric which provide patterning capabilities and which break-up the noticeable alignment of the longitudinal rows that detract from the appearance of a carpet. Moreover, when using yarns of different color in different needles the shifting selectively transfers yarns of one color into a row normally having a different color. For example, U.S. Pat. of Bryant et.al. No. 3,026,830, Mar. 27, 1962 discloses a sliding needle bar mechanism so as to shift the needle bar laterally as it is reciprocated so that the needles on successive penetrations selectively cooperate with different individual loopers. In U.S. Pat. of Broadrick No. 3,100, 465, Aug. 13, 1963, and Barnes No. 3,393,654, July 23, 1968 a wave line attachment or backing fabric shifter are illustrated which shifts the backing fabric laterally as it is advanced longitudinally through the machine. A third type of shifting device is illustrated in U.S. Pat. of Card No. of Card 3,301,205, Jan. 31, 1967 in which the backing fabric supporting needle plate of the tufting machine is shifted laterally with the backing fabric held thereon while allowing longitudinal movement of the backing fabric relative to the needle plate.

In each of these known shifting arrangements relative lateral movement between the needles and the backing fabric is controlled by a pattern cam similar to that illustrated in the aforesaid Card patent. Due to the physical limitations of cams the maximum amount of relative shift between the backing and the needles is limited generally to four to six gauge spaces. Moveover, since there is a longitudinal pattern repeat every revolution of the pattern cam, the patterning capabilities of the prior art shifting devices are limited. The cams presently used to effect program shift are approximately one foot in diameter. To increase the pattern repeat interval would require that the cams be of greater diameter. However, the diameter and physical size of the cams are limited due to practical considerations. Moreover, the physical limitations of the cams and the difficulty in cutting intricate cams do not permit carpet designers the desired flexibility of pattern selection. Furthermore, another disadvantage of using pattern cams is that whenever a pattern is changed a different pattern cam must be installed. The time for changing cams together with the maintenance of the inventory of pre-cut pattern cams which must be on hand is an obvious disadvantage.

SUMMARY OF THE INVENTION

In order to overcome these deficiencies of the prior art shifters and to expand the patterning capabilities of tufting machines the present invention provides a novel patterning device which provides programmed transverse movement for any of the referred to shifting systems. The novel patterning device of this invention does not utilize pattern cams and therefore does not have the limitation of the prior art shifters. Wide variations of the shifting movements of needle bar, needle plate and backing fabric are made possible and therefore wide variation of pattern effects may be obtained. In the preferred embodiment a tape having a program in the form of holes punched in accordance with a pattern is provided to control the output of the shifter.

In the preferred form of the invention the patterning device includes a rotary drive member carrying three cams and driven in timed relation with the tufting machine. Two of the cams each act to cyclically reciprocate a respective pawl carrying member in opposite directions toward and away from the other during a substantial portion of each cycle. Two sets of ratchet teeth one for each pawl are secured to an output drive member which may couple to one of the aforesaid shifting systems. Programmed means is provided to selectively engage one of the pawls with its respective set of ratchet teeth during a portion of the cycle when each carrier is moving in a direction relative to its set of ratchet teeth such that the engaged pawl slips over the corresponding ratchet teeth without transferring any motion to the ratchet. When the carriers are next driven in the reverse direction, motion is transmitted to the ratchet by the engaged pawl. The third cam controls a locking tooth to cyclically engage with and disengage from a set of teeth in an alignment plate secured to the output drive member. The locking tooth is engaged during a major portion every cycle, and disengages only during that portion of the cycle in which the pawl carriers are moving in the motion transmitting direction with an engaged pawl. The major part of the disengagement of the tooth is a controlled clearance and the tooth is still within the confines of the valley of the alignment plate teeth. This arrangement serves to keep the mechanism of the device rigid during needle penetration and prevents runaway of the output drive member during shifting. The locking tooth may be selectively secured in the engaged position when no relative transverse movement between the needles and backing fabric is desired, i.e., during straight stitching operation, upon receipt of a signal from the programmed means.

The patterning device is cyclically timed such that the lock tooth releases the alignment plate teeth a short time prior to the tufting machine needle bar reaching top dead center, and reengages with the alignment teeth a short time after needle bar top dead center. The pawl carriers preferably are not moving but dwell from needle bar bottom dead center to slightly after the lock tooth releases, and moves in the force transmitting direction from this point until slightly before the lock tooth reengages. At this time the pawl carriers change direction and move in the pawl slipping direction until needle bar bottom dead center. The selected pawl may be actuated while the carriers are moving in the pawl slipping direction or during the dwell period.

Another aspect of this invention is the synchronization of the signal from the program to the pawl actuating means, which preferably are solenoids. The synchronization preferably occurs by means of a timing disk operating in conjunction with a proximity probe which allows the information from the program to energize the selected solenoid at the appropriate point in the cycle.

Accordingly, it is a primary object of the present invention to provide a patterning device for effecting wide variations of lateral shifting of the individual yarns of a tufted fabric to thereby provide wide variations of pattern effects in the tufted fabric.

Another object of this invention is to provide relative lateral movement between the needles of a tufter and the backing fabric by a shifting device cntrolled by a programmed source.

A further object of this invention is to provide a device having a program controlled laterally moving output drive that can provide relative lateral movement between the needles of a tufting machine and the tufted fabric.

A still further object of this invention is to provide an intermittent programmed drive for a shifter cyclically providing relative lateral movement between the needles of a tufting machine and the backing fabric and which cyclically locks the shifter between each lateral shifting movement.

A yet still further object of this invention is to provide a device for effecting relative lateral shifting between the needles of a tufter and the tufted fabric while the needles are free of the fabric and which is substantially secured against lateral movement at all other times.

A still yet further object of this invention is to provide a device of the type described which is reliable and substantially fail safe.

BRIEF DESCRIPTION OF THE DRAWINGS

Other objects and advantages of this invention will best be understood upon reading the following detailed description of the invention with the accompanying drawings, in which:

FIG. 3 is a sectional view taken substantially along line 3—3 of FIG. 2 illustrating the assembly of the carrier blocks and slide plate within the housing of the device;

FIG. 7 is a graph illustrating the preferred timing cycle of the patterning device.

DETAILED DESCRIPTION OF THE PREFERRED EMBODIMENT

Figure 1:
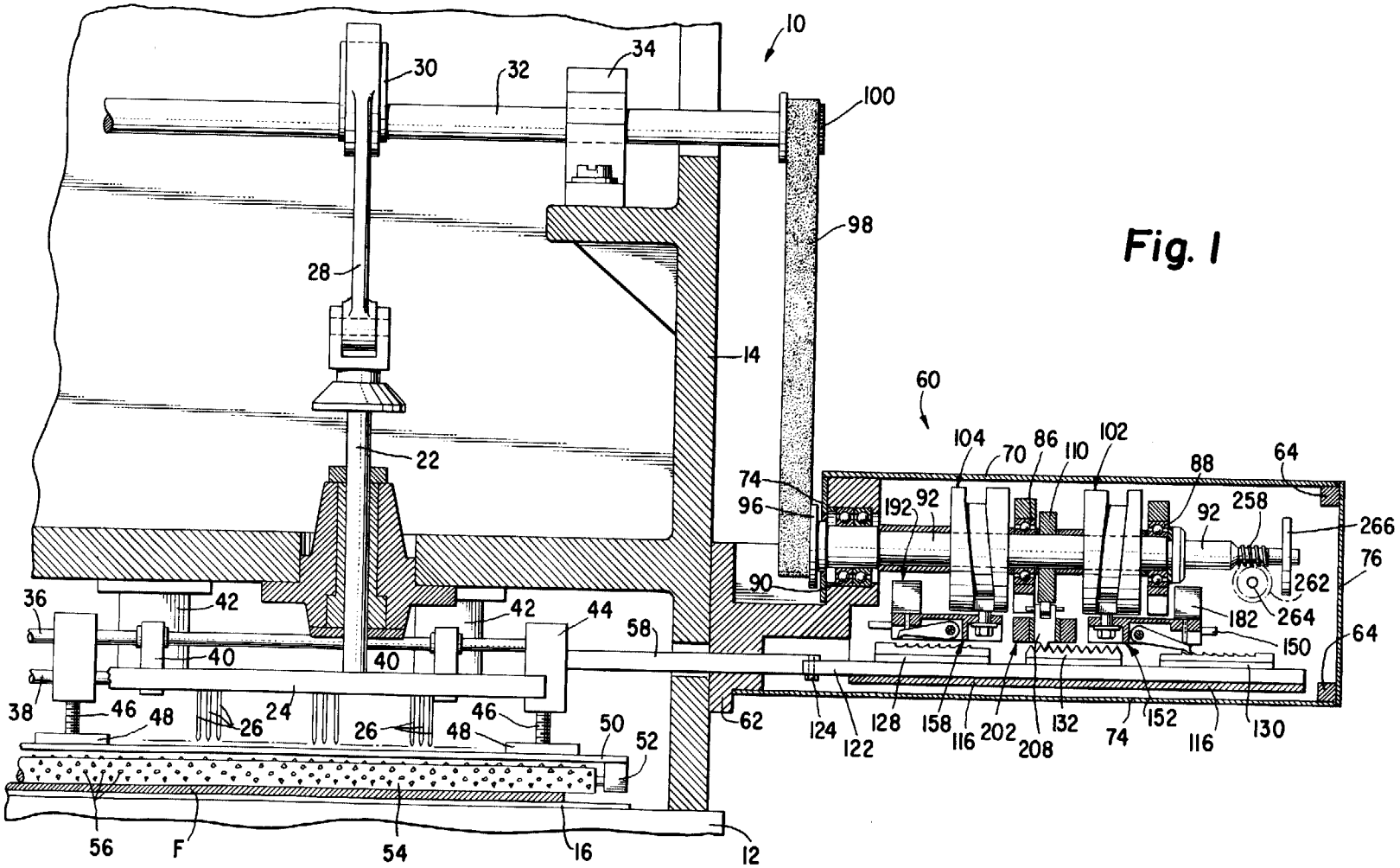
FIG. 1 is a fragmentary sectional view of a tufting machine incorporating a backing fabric shifter including a patterning device constructed in accordance with the present invention.

Referring now to the drawings there is illustrated a portion of a tufting machine 10 having a frame comprising a base 12 and a head 14 disposed above the base. The base 12 includes a needle plate 16 over which a backing fabric F is adapted to be fed in a conventional manner.

Mounted in the head 14 for vertical reciprocation is one of a plurality of push rods 22 to the lower end of which a needle bar 24 is carried and which in turn carries a plurality of needles 26 that are adapted to penetrate the fabric F on the needle plate 16 upon reciprocation of the needle bar 24 to project loops of yarn therethrough. Endwise reciprocation is imparted to the push rod 22 and thus the needle bar 24 and needles 26 by a link 28 which is pivotably connected at its lower end to the push rods 22 and at its upper end to an eccentric 30 on a driven rotary main shaft 32 that is journalled longitudinally in bearing blocks 34 mounted in the head. Although not illustrated a plurality of hooks adapted to cooperate individually with one of the needles to seize a loop of yarn presented by the needle and to hold the same as the needle is withdrawn is conventionally mounted for oscillating motion beneath the needle plate 16. Looper constructions of this type are illustrated, for example, in U.S. Pats. Nos. of Card, 2,976,829, Mar. 28, 1961 and 3,084,645, Apr. 9, 1963.

In order to provide relative lateral shifting between the needles 26 and the backing fabric F, the machine may be provided with a sliding needle bar mechanism in which the needle bar is supported for lateral sliding movement within a guide-way affixed to the push rods as disclosed in the aforesaid patent of Bryant et.al., or alternately the machine may be provided with a sliding needle plate in which case the needle plate slides in a guide-way as illustrated in the aforesaid Card U.S. Pat. No. 3,301,205, or alternately the machine may be provided with a backing fabric shifter. For purposes of illustration only, the present invention is disclosed in conjunction with the latter shifting system, but it should be understood that it is applicable to drive a sliding needle bar or a sliding needle plate.

The backing fabric shifter comprises preferably a pair of slide shafts 36 and 38 supported for lateral sliding movement in a plurality of linear bearing blocks 40 which are secured to brackets 42 secured to the frame of the tufting machine. A plurality of split clamping blocks 44 are secured to the slide shafts and include threaded adjusting rods 46 extending from the lower end thereof and on the free end of which is secured a respective foot 48. The feet 48 are attached to a laterally extending cross bar 50 having a plurality of bearing blocks 52 only one of which is illustrated, and between each two of which is journalled a picker roll 54 having a multiplicity of spikes or picks 56 adapted to engage the upper surface of the backing fabric F. Thus, as the shafts 36 and 38 are laterally translated, the picks of the picker row, which is rotated by the action of the backing being fed over the needle plate, grip the backing fabric sufficiently to impart lateral movement thereto. A drive bar 58 may be secured to one of the clamping blocks 44, as illustrated, or to a separate drive block (not shown) fixed to the slide shafts 36 and 38 in a manner similar to the clamping blocks in order to impart selective lateral movement thereto.

Figure 2:
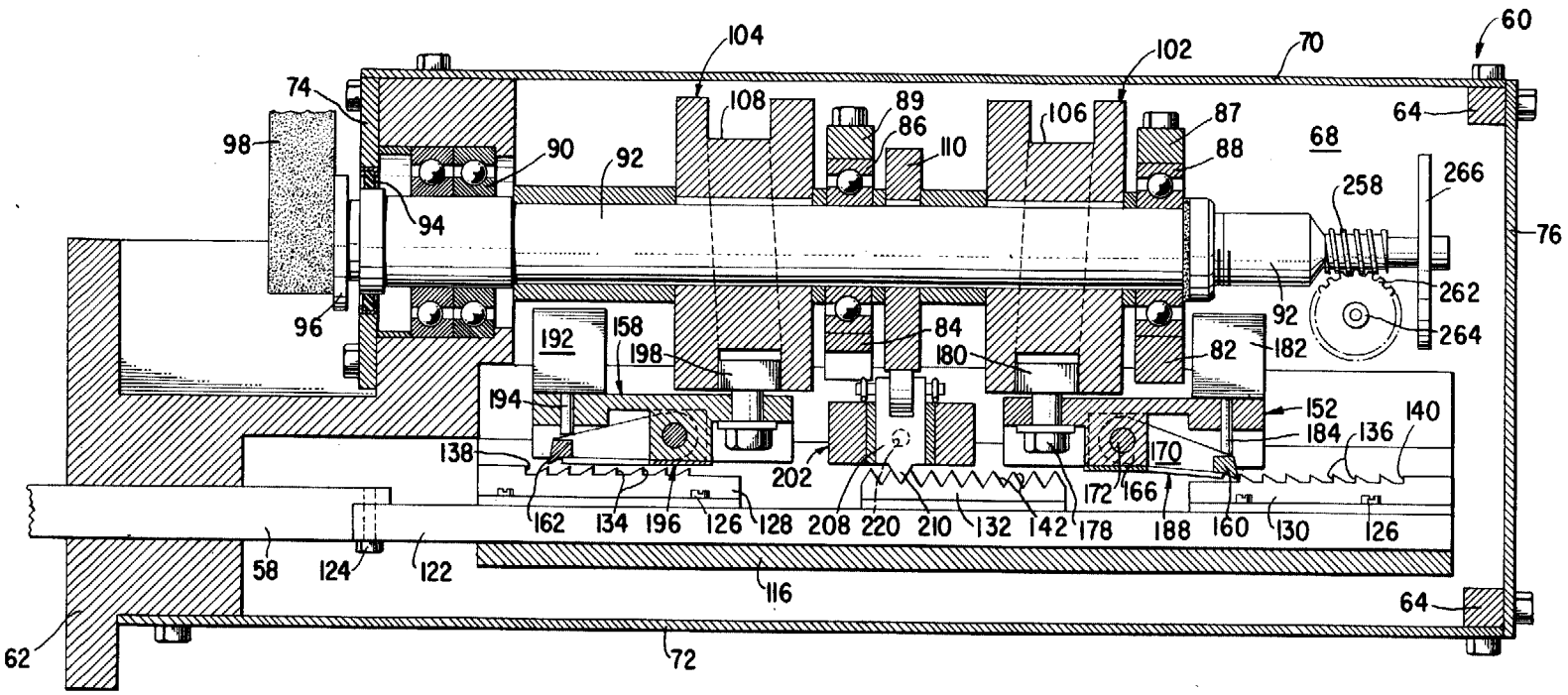
FIG. 2 is an enlarged sectional view of the patterning device illustrated in FIG. 1.
Figure 4:
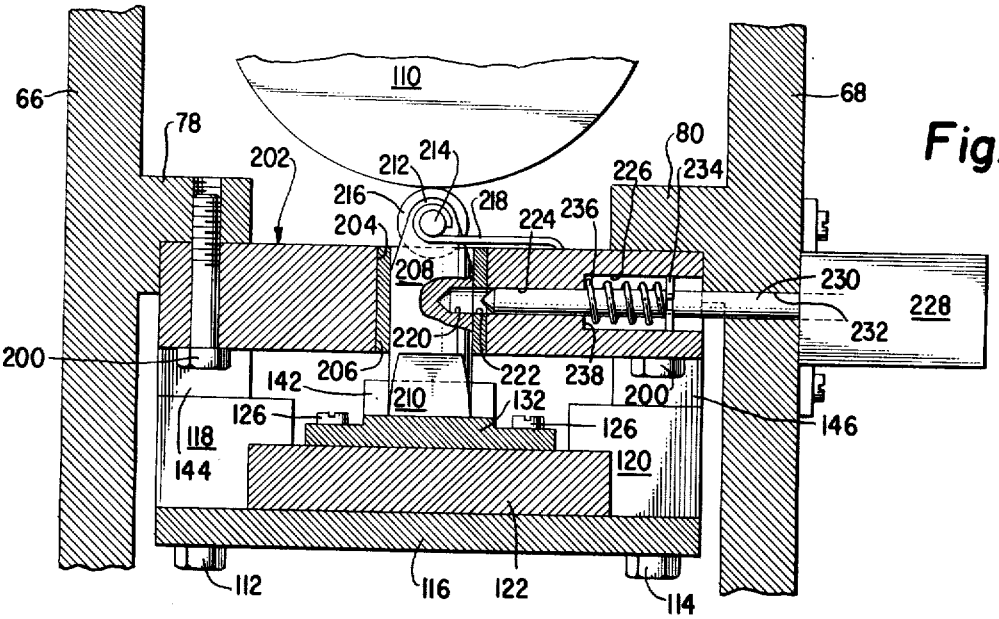
FIG. 4 is a fragmentary sectional view taken substantially along line 4—4 of FIG. 2 illustrating the construction of the locking tooth securing system.

In order to drive the drive bar 58 selectively with controlled lateral movement there is provided a new and improved patterning device according to the present invention and designated generally at 60. The patterning device 60 comprises a housing, best illustrated in FIG. 2, including a pair of end frame members 62 and 64 to which front and rear side frame members 66 and 68 respectively are secured, preferably by welding. Top and bottom plates 70 and 72 respectively are preferably bolted to the frame, as may be end plate members 74 and 76 to enclose the housing. Formed integral with, or secured as by welding to, each of the side members 66 and 68 is a respective support rail 78 and 80. A pair of spaced bearing blocks 82 and 84 are preferably welded to each of the walls 66 and 68 and to the rails 78 and 80 for receiving rotary bearings 86 and 88 secured in place by bearing caps 87 and 89 bolted to the respective blocks 82 and 84. Preferably a double thrust bearing 90 is positioned in the end frame member 62. Journalled in and supported by the bearings 86, 88 and 90 is a shaft 92 which extends out of the housing through an aperture in the end plate member 74. An oil seal 94 may be provided between the bearing area and the outside of the member 74. The housing of the device 60 is preferably secured to the head 14 of the tufting machine by bolts (not illustrated) between the end member 62 and the head 14. Fixed on this end of the shaft may be a pulley 96 driven through a belt 98 trained about the pulley 96 and a pulley 100 fixed to the corresponding end of the main shaft 32 of the tufting machine so that the shaft 92 is driven in timed relationship with the needle bar 24.

Rotatably fixed to the shaft 92 are a pair of spaced cylindrical or barrel type cams 102 and 104 having respective cam tracks in the form of grooves 106 and 108 cut in the circumference of the barrel. In this type of cam a follower riding in the groove will translate in a direction substantially parallel to the axis of the shaft 92. Preferably the profile of the groove is cut such that for approximately 120 degrees of cam rotation the follower will move in a first direction, for the next approximately 120 degrees the follower will move in the opposite direction, and for the other approximately 120 degrees of rotation of the cam the follower will dwell. This preferred travel of the follower in each groove 106 and 108 is illustrated graphically in FIG. 7 by the curve designated P.C. to which further reference will hereinafter be made. The groove in the cams are such that a follower in each groove will move in opposite directions toward and away from each other and will dwell at the same time. In the preferred construction, since the follower travel curve is symmetrical, the cam grooves are mirror images of each other so that these cams are the same but installed oppositely on the shaft 92. A third cam 110 which is preferably of the disk type is fixed to the shaft 92 intermediate cams 102 and 104. The surface of this cam is the track and is preferably cut such that a follower riding against it will rise for approximately 65 degrees, fall for approximately 65 degrees and dwell at the lower position for the remaining period of approximately 230 degrees. This preferred travel is graphically illustrated by the curve L.T. in FIG. 7 and will be described in further detail.

Supported from the rails 78 and 80 by a plurality of bolts 112 and 114 at the front and rear sides respectively, is a laterally extending support or bearing plate 116. Positioned on the bearing plate 116 are a pair of guide blocks 118 and 120. The guide blocks preferably comprise inverted L-shaped bars having one leg positioned at the front and rear edges respectively of the bearing plate 116 and having the other legs facing inwardly toward each other as best illustrated in FIG. 3. Thus, the guide blocks together form a guide-way between which a drive bar slide plate 122 may translate laterally while supported on the bearing plate 116. This slide plate 122 is an elongated member which extends towards the tufting machine and is coupled to the drive bar 58 by conventional means such as a bolted lap joint 124 so as to impart its motion thereto.

Secured as by screws 126 on the upper portions of the slide plate 122 are a pair of spaced ratchet plates 128 and 130 and an alignment plate 132 positioned intermediate said ratchet plates. For reasons which will hereinafter become clear the ratchet plates 128 and 130 each respectively have a plurality of teeth 134 and 136 having a force transmitting substantially vertical surface and a slip surface sloping upwardly towards a common vertical, i.e., toward the end opposite to which the ratchet is located. Each ratchet plate 128 and 130 is illustrated as having seven teeth 134 and 136 respectively so that together with the vertical surface of its respective end 138 and 140 there are eight lateral steps or shifts. However, this number can be varied depending on the shifting space available within the tufting machine for the fabric shifter (or sliding needle bar or sliding needle plate). The vertical surfaces on the teeth and end of each ratchet plate are preferably spaced apart by the machine gauge space, i.e., the space between the laterally spaced needles or loopers of the tufting machine. However, the space between the teeth need not be of such a spacing since a multiplication linkage between drive bar 58 and plate 122 may be incorporated so that a single set of ratchet teeth can be used with machines of differing gauges. The alignment plate 132 is a locking keeper member which includes a plurality of teeth 142 sloping on both sides from a crest to a nadir with the valley between the teeth. The number of teeth being such that there is at least one more valley than there are lateral shifts provided by the ratchets for reasons hereinafter explained.

Positioned on the guide blocks 118 and 120 except in a central portion thereof there are a pair of front and rear spacer blocks 144 and 146 respectively, and mounted between each spacer block and the rails 78 and 80 are respective front and rear track members 148 and 150. The bolts 112 and 114 rigidly secure the bearing plate 116, the guide blocks 118 and 120, the spacers 144 and 146 and the track members 148 and 150 to the rails 78 and 80. A pawl carrier block or carriage 152 having front and rear laterally extending grooves 154 and 156 respectively forming slideways for receiving the track members 148 and 150 is positioned on the track members at the ratchet plate 130 end, and a similar pawl carrier or carriage 158 is positioned on the track members at the ratchet plate 128 end. Each carrier 152 and 158 supports a respective pivotably mounted pawl 160 and 162 as hereinafter described.

Figure 5:
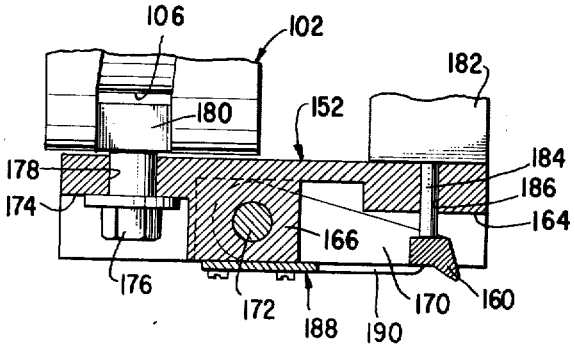
FIG. 5 is an enlarged fragmentary view in section illustrating the construction of a pawl and carrier block.

Since the pawl carriers 152 and 158 are the same, and the pawls 160 and 162 are the same only the carrier 152 and pawl 160 will be described, it being understood that the same description applies to carrier 158 and pawl 162. As best illustrated in FIGS. 3 and 5 the pawl carrier 152 on the underside thereof includes a substantially centrally located recess 164 to provide clearance within which the pawl swings. Within the recess, laterally spaced from its side edges and its leading edge, is a downwardly extending block-type protuberance 166. Positioned between each side of the protuberance and the facing side wall of the recess is a respective arm member 168 and 170 which are pivotably mounted to the protuberance 168 and the sidewalls of the recess by means of a pin 172. The other ends of the arms 168 and 170 are secured to the pawl 160 so the pawl may pivot about the pin 172. A further recess 174 is centrally located in the carrier 152 spaced laterally from the first recess 164. A bolt 176 extends through a hole 178 in the upper wall of the carrier and is secured to a cam follower 180 which is positioned within the cam groove 106 so as to be driven thereby. Positioned on the top wall of the carrier 152 on the pawl end thereof is a solenoid 182 having its output rod 184 extending downwardly through a hole 186 formed in the upper wall of the carrier. A leaf spring 188 is secured to the bottom of the protuberance 166 and includes one or more arms 190 which act against the adjacent edge of the pawl to normally bias the pawl upwardly against the solenoid rod 184. When the solenoid is energized the force of the spring is overcome and the pawl is forced downwardly. Similarly, there is a solenoid 192, a solenoid rod 194 a spring 196 and a follower 198 associated with the carrier 158 and pawl 162. The follower 198 tracks within the cam groove 108 of the cam 104.

Secured by bolts 200 to the rails 78 and 80 beneath the locking cam 110 is a lock tooth support and guide plate 202 having a central opening 204 within which is positioned a bushing 206. Positioned within the bushing is a substantially cylindrical locking tooth body 208 having a tapered tooth portion 210 at its lower end. The tooth portion 210 is shaped so as to fit within and substantially complement the valleys of the teeth 142 in the alignment plate 132 so as to prevent movement of the slide plate 122 when the tooth 210 is wedged between the teeth 142. The upper portion of the locking tooth body comprises bifurcated limbs 212 having coaxial apertures through both of which an axle member 214 extends. Mounted on the axle between the limbs 212 is a roller type follower 216. A torsion spring 218 may be positioned on each end of the axle 214 and fixed to the support and guide plate 202 to urge the follower 216 upwardly into contact with the peripheral surface of the locking cam 110 so as to follow its vertical undulations. The movement of the follower of course controls the movement of the lock tooth body 208 and the engagement, release and disengagement of the tooth portion 210 with the valleys of the alignment plate 132. Moreover, the contour of cam 110 together with the dimensions of the follower and tooth is such that complete disengagement of the tooth 210 from the alignment plate teeth occurs only near the very top of the travel. Prior to this the tooth merely is released from wedging engagement but is within the valley between two teeth 142. Thus, there is a controlled clearance between tooth 210 and the valleys between teeth 142. The tooth thus slides up the sloping side of one tooth 142 and down the sloping side of the adjacent tooth depending on which way the plate 122 is shifted.

The operation of the shifting device will now be described with particular reference to graphs in FIG. 7. The curve designated N.B. illustrates the relative vertical travel of the tufting machine needle bar 24 as a function of the rotation of the tufting machine crank or main shaft 32. Thus, needle bar top dead center (relative travel 1.0) is at 180° of crank rotation, and bottom dead center is at 0° or 360°. This curve illustrates the conventional sinusoidal movement of the tufting machine bar. Similarly the curve denoted P.C. illustrates the relative horizontal travel of each of the pawl carriers 152 and 158, and the curve denoted L.T. illustrates the vertical movement of the locking tooth 210 as functions of the tufting machine main shaft rotation.

The basic timing cycle will first be described. Beginning at the time the needle bar is at bottom dead center or 0° crank angle the pawl carriers 152 and 158 have reached the end of their travel and are at their closest position, and the lock tooth 210 is down in locking engagement with a valley between the teeth 142 of the alignment plate 132. As the needle bar raises for during approximately the next 115° the pawl carriers dwell at their closest position and the lock tooth remains in locking engagement with the teeth 142. At about this time the lock tooth begins to rise and release the alignment plate. Approximately 5° later, i.e., approximately 120° of crank angle the pawl carriers commence movement away from each other. At this time the needles 26 are safely free of the needle plate 16. At approximately needle bar top dead center, i.e., 180° the lock tooth 210 reaches its maximum elevation and begins to fall as the needle bar begins its down stroke. However, only between a few degrees above and below this top dead center position is the tooth 210 is completely free of the alignment plate. This small time illustrated at 219 in FIG. 7 is approximately between 3° and 10° on each side of top dead center. During the remaining period of the release of the alignment plate, the tooth 210 is under controlled clearance from the alignment plate and is within the confines of a valley. The pawl carriers 152 and 158 meanwhile continue moving away from each other until approximately 240° crank angle at which point they are at maximum separation and begin moving in the opposite direction. Approximately 5° later, i.e., approximately 245° of crank rotation the lock tooth is firmly seated by wedging within a valley between teeth of the alignment plate 132 to lock the slide plate 122 against movement. The lock tooth remains so engaged for the remainder of the cycle as the pawl carriers are moving toward each other and the needle bar reaches bottom dead center.

Now, when a signal is transmitted from the pattern program to one of the solenoids 182 or 192 as hereinafter described, the selected solenoid is energized. This occurs at approximately 240° of crank rotation and is indicated in FIG. 7 by the mark designated P. The solenoid is allowed approximately 60° to overcome inertia and other forces to seat against and settle the selected pawl 160 or 162 which is thus seated at approximately 300° and thus engages its corresponding ratchet 128 or 130 as indicated in FIG. 7 by the arrow designated S. This seating of the pawl occurs while the pawl carriers are moving toward each other which, due to the slope of the ratchet teeth 134 and 136, is the pawl slipping direction. Thus, the selected pawl does not do any work until the next cycle when the lock tooth releases the alignment plate and the pawl carriers are moving away from each other between approximately 120° and 240°. During this period of work or motion transmission the needles 26 are safely above the needle plate 16 and a pawl transmits the motion of the carriers to the corresponding ratchet to drive the same. This motion is thereby transferred to the slide plate 122 and thus to the drive bar 58 to effect one step of relative shifting between the needle bar and the backing fabric F. For example, if during the cycle a pattern for the next stitch calls for shifting of the drive bar 58 to the right as viewed in FIG. 1, the solenoid 182 is actuated to force the pawl 160 into the ratchet teeth 136 of the ratchet 130. Then between 120° and 240° of the next cycle the ratchet 130 and thus the drive bar 58 is forced one step to the right. If the following stitch calls for a shift to the left, then at 240° the pattern deenergizes solenoid 182 and energizes solenoid 192. During the next cycle, the pawl 162 will drive the ratchet 128 one step to the left. It should be understood that the solenoid is preferably energized and seated during the pawl slipping portion of the cycle, i.e., between 240° and 360°, but selection of this interval was made so as to give the pawls as much time as possible to seat. It could be energized and seated at any time the pawl carriers are moving in the slipping direction or are dwelling — i.e., between 240° of one cycle and 120° of the next cycle.

Lock tooth 210 serves to hold everything rigid during the time it is engaged with an alignment plate tooth. This occurs during the entire cycle except during the pawl work transmitting portion and a short time before and after, i.e., except between approximately 115° and 245°. The 5° on each side of the pawl work transmitting portion is for safety purposes so as to insure that a clearance exists between the lock tooth and the alignment plate when motion is to be transmitted. Thus, during needle penetration of the backing fabric the needle penetration forces and reaction forces do not shift the drive bar 58 and the slide plate 122 and therefore does not change the proper relationship of these parts to the pawls, or change the positioning of the next stitches. Also, since the tooth is within the confines of a valley except for the very small interval 219, any spring-back of the plate 122 due to the springiness of the fabric, (especially in a fabric shifting system) is minimized. The lock tooth also corrects for inaccuracies due to tolerances etc. which could prevent the pawls from giving the exact shift desired. It does this by its wedging action into the valleys between the teeth 142. If a pawl does not shift a ratchet by exactly one tooth or gauge part space, then the lock tooth when it re-seats in the teeth 142 will move the alignment plate and thereby the slide plate 122 and drive bar 58 to correct for this. It therefore provides an additional safety feature.

A third function of the lock tooth 210 is to lock the mechanism during a straight stitch as called for by the pattern. For this purpose the lock tooth is provided with an aperture 220 preferably horizontally disposed in the rear surface. Concentric with the aperture 220 are similar apertures 222 and 224 respectively in the bushing 206 and the lock tooth support and guide plate 202, the aperture 224 opening into an enlarged aperture 226 in the guide plate. A straight stitch solenoid 228 is secured to the rear side member 68 with its rod 230 extending to a hole 232 in the member 68 and into the aperture 224. A snap ring 234 is positioned about a groove on the rod 230 within the aperture 226 and a spring 236 is coiled about the rod between the snap ring and the shoulder 238 formed about the aperture 224. Thus, when the pattern calls for a straight stitch the solenoid 228 is energized which forces the rod 230 into the aperture 220 to secure the lock tooth 210 within the alignment plate. This releases the follower 216 from following the cam 110 until the solenoid 228 is deenergized to rapidly withdraw the rod 230 from aperture 220 by the action of the spring 236. Energization of the solenoid 228 occurs at 240° and simultaneously the solenoids 182 and 192 are deenergized. The energized solenoid 228 thus keeps the slide plate 122 from shifting and effects straight stitching. When a shift is called for by the pattern the solenoid 228 is deenergized and one of the solenoids 182 or 192 is energized as above described.

Figure 6:
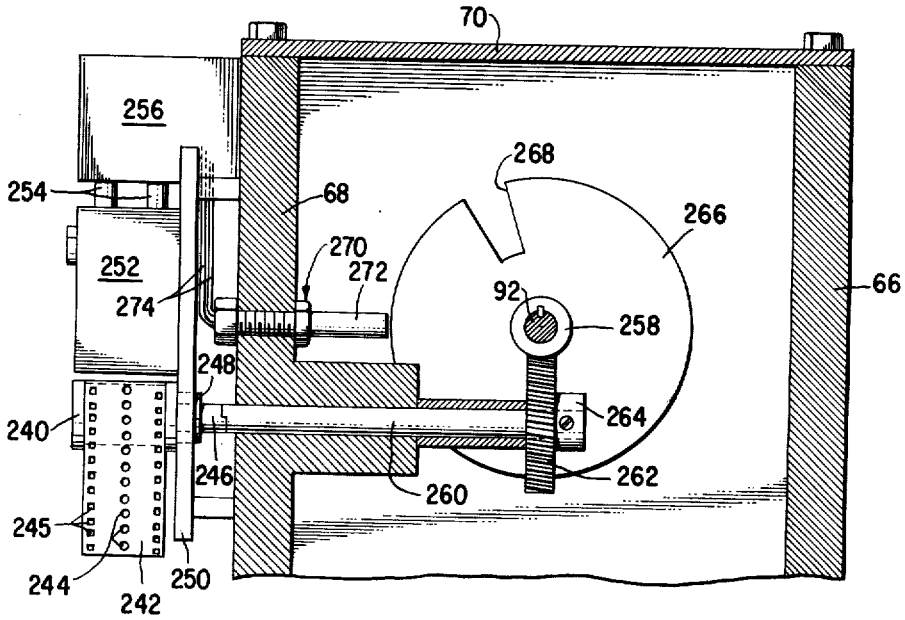
FIG. 6 is a fragmentary sectional view taken substantially along line 6—6 of FIG. 2 illustrating the construction of the program controller and the signal synchronization means.

In order to control the action of the solenoids and therefore the tufted pattern produced by the tufting machine, timed electrical signals are selectively transmitted to the solenoids in accordance with a programmed pattern. The preferred medium for storing the pattern in the form of a program is a punched tape. This type of medium provides the advantages of flexibility of pattern changing, minimum space for storage of the medium, and a simple and inexpensive process for entering the pattern information. One form of program controller for reading the program on the tape and generating the timed sequence of electrical signals to operate the solenoids is illustrated in FIG. 6. This program controller, which is fully described in U.S. Pat. No. of Neidenberg et. al. 3,511,976, May 12, 1970, includes a rotary cyclindrical drum 240 having an electrically conductive surface over which the punched tape 242 is trained. The tape includes a plurality of sprocket holes 244 in which sprocket teeth formed circumferentially on the drum are adapted to extend to drive the tape. The program is punched in the tape in the form of holes 245. The drum 240 is mounted on a shaft 246 journalled in a housing 248 secured to a panel 250. The panel is attached to the rear side member 68 of the patterning device housing. Mounted above the drum 240 is housing 252 within which is supported a brush contact frame (not shown) supporting a plurality of electrical contact brushes (also not shown) which ride on the surface of the tape and make contact with the drum through the holes 245 in the tape. The brush frame may be selectively swung away from the drum to permit withdrawal or insertion of the tape on the drum. Preferably there is one brush per channel of information on the tape. Each brush is connected to conductors extending through conduits 254 connecting into a circuit located within an electrical circuit and junction box 256. A common brush contact (not shown) is mounted so as to always contact the conductive surface of the drum and whenever one of the other brushes engages the drum through a punched hole 245 in the tape the circuit for that channel is closed. When no hole is present the circuit is open. Circuit closure is programmed on a line basis along the longitudinal axis of the tape. The tape may be endless, as illustrated, or may be one wound from one reel onto another. For a more complete disclosure of the program controller reference may be had to the aforesaid Neidenberg et. al. patent.

In order to drive the tape in timed relationship with the patterning device the present invention provides a worm 258 keyed on a reduced portion of the free end of the shaft 92. A stub shaft 260 journalled in the rear member 68 is coupled to the shaft 246 of the drum 240 and supports a worm wheel 262 secured thereto by its hub 264. The worm 258 meshes with and drives the worm wheel 262 and thereby the drum 240 in timed relationship with the shaft 92 and therefore the main shaft 32 of the tufting machine. Moreover, in order to sychronize the signals from the tape program with the rotational cycle of the patterning device and the tufting machine so that the solenoids may be energized at the proper instant of the cycle, i.e., preferably at 240° of crank rotation as described in conjunction with FIG. 7, a metallic timing disk 266 is fixed on the shaft 92 adjacent the free end and includes a slotted truncated radial opening 268 approximately 15° in arc. A proximity probe 270 is threadedly mounted in the wall 68 and includes a sensing head 272 extending toward and just spaced from the circumference of the disk 266. The probe which is basically a metal detector, includes conducting leads 274 which extend into circuit box 256 and connect to a proximity switch 276 (see FIG. 8) in the circuit with the brushes of the program controller. Whenever the solid circumference of the disk is adjacent the probe head 272 the primary output of the sensor goes high and when the slot 268 passes the head 272 the primary output is switched low. A timed pulse is thereby provided so as to energize the appropriate solenoid is provided by the circuitry of this invention upon receiving the low signal from the proximity head primary output.

Figure 8:
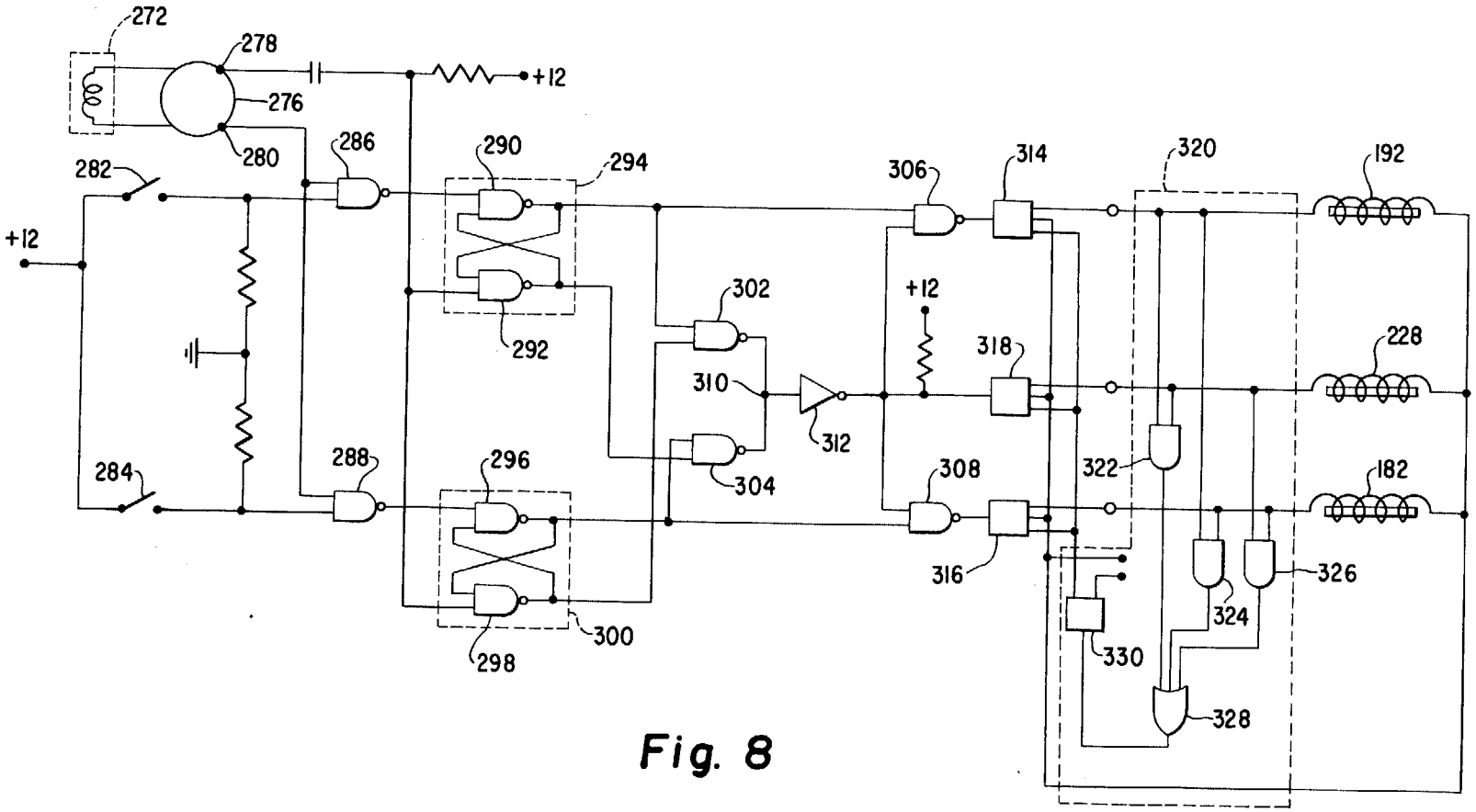
FIG. 8 is a schematic drawing of the circuitry for actuating the pawls and securing the locking tooth and for preventing actuation of more than one of these members at any time.

A schematic drawing of the electrical circuitry is illustrated in FIG. 8 wherein the proximity switch 276 includes a primary output terminal 278 having secondary terminal 280, and the program controller includes a left channel switch 282 and a right channel switch 284 actuated by the brush contacts as determined by the program on the tape 242. The outputs from the proximity switch on the program controller are fed to a pair of parallel connected NAND gates 286 and 288. The output of NAND gate 286 is fed to another NAND gate 290 connected in flip-flop with another NAND gate 292 to comprise a latch 294, the output of NAND gate 288 is similarly fed to a NAND gate 296 which together with NAND gate 298 comprises a latch 300. The output of the latches 294 and 300 are cross-connected to NAND gates 302 and 304 with the output of the gate 292 fed to gate 304, the output of gate 298 fed to gate 302 and the outputs of gate 290 fed to gate 302 and a parallel NAND gate 306, and the output of gate 296 fed in parallel to gate 304 and gate 308. The outputs of the gates 302 and 304 are fed to a wired junction 310 which functions as an AND, whose output feeds an inverter 312. Each NAND gate 306 and 308, and inverter 312 are connected to a respective a.c. switch 314, 316 and 318 which close and turn on when fed by a low signal. The a.c. switches 314, 316 and 318 control the respective solenoids 192, 182 and 228.

In operation assuming the left channel 282 is closed, a high signal is sent to the gate 286, and when the slot 268 of the disk 266 passes the probe 272 the primary output terminal 278 of the proximity switch 276 rapidly goes low, and the terminal 280 goes high. Thus, two highs enter the NAND gate 286 and its output therefore goes low. Simultaneously, since the right channel 284 is open, a low signal is sent to gate 288 and its output switch stays high. The gates 290 and 292 thus have lows entering and therefore produce highs at their outputs. The gate 298 receives the low from output terminal 278 and its output goes high. Thus two highs enter gate 296 so that its output is a low. Two high signals therefore enter NAND gate 302 so its output is a low, while the high and low signals entering NAND gate 304 produce a high at its output. The high and low signals are combined in junction 310 which pulls the high down to produce a low causing inverter 312 to produce a high. This high signal feeds gates 306 and 308 which receives a high and a low signal respectively from latch 294 and 300. Gates 306 and 308, thereby go low and high respectively. Thus since switches 314, 316 and 318 are turned on by a low signal and off by a high signal switch 314 closes the circuit to solenoid 192, while switches 316 and 318 open the circuits to solenoids 182 and 228 respectively. The left solenoid 192 is therefore energized to engage the pawl 162.

In a similar manner with the right channel 284 closed, the proximity probe 272 low pulse at its output 278 results in solenoids 192 and 228 being deenergized and right solenoid 182 energized to engage pawl 160.

When neither the right or left channel is closed, i.e., a straight stitch is called for by the pattern tape 242, or when both the right and left channel are closed due to a mispunched tape, the logic used in the circuitry provides a low at switch 318 and highs at switches 314 and 316. Thus, only solenoid 228 is energized.

A safety override is also provided to the circuitry of this invention so as to insure that if there is a failure in the circuitry which would result in more than one solenoid being energized at the same time, the a.c. electrical supply is shut off. This master override is indicated by the dash lines 320 which define a secondary inhibitor circuit. It comprises three AND gates 322, 324 and 326 connected across each two lines from switches 314, 316 and 318 to the respective solenoids. These AND gates feed OR gate 328 whose output supplies an a.c. switch 330 similar to switches 314, 316 and 318. Thus, if any two of the switches 314, 316 or 318 are closed the output of OR gate 328 is high so that the switch 330 opens to open the a.c. supply.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modification which do not depart from the spirit of the invention are intended to be included within the scope of the appended claims.

Having thus described the nature of the invention, what we claim herein as:

1. A patterning device for a tufting machine having a plurality of reciprocating needles disposed laterally across the machine and adapted to penetrate a backing fabric moving longitudinally of the machine to insert a plurality of stitches upon each penetration of the backing fabric, and shiftable means including a drive bar for providing relative lateral movement between the needles and the backing fabric, said patterning device comprising: a housing, carriage means supported in said housing for oscillatory translational movement, means for driving said carriage means in a first direction and in a second direction opposite to said first direction in timed relationship with the reciprocation of said needles, said carriage means moving in said first direction while said needles are free of said backing fabric, a motion transferring member mounted in said housing, complementary coupling means carried by said carriage means and said motion transferring member for coupling the motion transferring member selectively to the carriage only when the carriage means is moving in said first direction, pattern control means for actuating said coupling means selectively prior to movement of said carriage means in said first direction, said motion transferring member including a keeper member, a locking tooth journalled in said housing for engagement with said keeper member for securing said motion transferring member, locking tooth control means operable in timed relationship with the reciprocation of said needles for holding said locking tooth in locking engagement with said keeper member and, for releasing said tooth from said keeper member only when said carriage means is moving in said first direction and means for connecting said motion transferring member to said drive bar.

2. A patterning device as recited in claim 1 wherein said locking tooth control means includes a cam member driven in timed relationship with said needles, a follower secured to said locking tooth and biased into engagement with said cam, said cam having a follower engaging surface such that the locking tooth is held in locking engagement with the keeper from a time slightly after the carrier has moved in said first direction until the next cycle just prior to the carrier moving in said first direction.

3. A patterning device as recited in claim 2 wherein said keeper comprises a plurality of spaced teeth, said locking tooth being wedged between adjacent keeper teeth after each movement of said carriage means in said first direction with an actuated coupling means.

4. A patterning device as recited in claim 3 wherein said carrier moves in said first direction during the interval that said tufting machine needles are between approximately 60° before the top of their stroke and 60° after the top of their stroke as determined by the needles moving in substantially simple harmonic motion.

5. A patterning device as recited in claim 3 wherein said complementary coupling means comprises pawl means mounted on said carrier means and ratchet means mounted on said motion transferring member, said ratchet having teeth disposed such that the pawl may slip over the ratchet when the carrier means is driven in said second direction.

6. A patterning device as recited in claim 5 wherein the spacing between adjacent ratchet teeth is substantially equal to the spacing between adjacent keeper teeth.

7. A patterning device as recited in claim 2 wherein said pattern control means comprises means for generating electrical pulses, said coupling means including solenoid means energized by said pulses for effecting coupling of said coupling means, and means for synchronizing said pulses with the movement of said carriage means such that coupling is effected while said locking tooth is in locking engagement with said keeper.

8. A patterning device as recited in claim 3 wherein said locking tooth control means controllably releases the locking tooth from wedging engagement with a first set of keeper teeth to provide a clearance between said tooth and said first set of teeth while maintaining said tooth between said first set of teeth during a portion of the movement of said carriage in the first direction, and thereafter frees said locking tooth from between said first set of teeth during a subsequent smaller portion of said movement of the carriage, and thereafter inserts said tooth between an adjacent set of keeper teeth while the carriage continues a final portion of said movements when the coupling means is actuated.

9. A patterning device as recited in claim 1 including means selectively controlled by said pattern control means for preventing coupling of the motion transferring member to the carriage and for further preventing releasing of said locking tooth from said keeper member.

10. A patterning device for a tufting machine having a plurality of reciprocating needles disposed laterally across the machine and adapted to penetrate a backing fabric moving longitudinally of the machine to insert a plurality of stitches upon each penetration of the backing fabric, and shiftable means including a drive bar for providing relative lateral movement between the needles and the backing fabric, said patterning device comprising: a housing, a drive shaft rotatably journalled in the housing, means for rotating said shaft in timed relationship with the reciprocation of said needles, means defining a guideway within said housing, carriage means slidably mounted on said guideway, means including first cam means mounted on said shaft for driving said carriage means in a first direction when said needles are free of the backing fabric and in a second direction opposite to said first direction, an output member, means for supporting said output member for sliding movement within said housing, a first coupling member and a keeper member operatively connected to said output member, a locking member supported in said housing for movement toward and away from said keeper member, including a second cam mounted on said shaft for driving and maintaining said locking member in locking engagement with said output member and for releasing said output member just prior to movement of said carriage in said first direction, said carriage including a normally disengaged second coupling member cooperable with said first coupling member for coupling said output member to said carriage member only while said carriage is moving in said first direction, pattern control means for selectively engaging said first and second coupling members, and means for connecting said output member to said drive bar.

11. A patterning device as recited in claim 10 wherein said keepr comprises a plurality of spaced teeth, said second cam being contoured to lock said locking member between adjacent teeth just after each movement of said carriage in said first direction.

12. A patterning device as recited in claim 11 wherein said first coupling member comprises a ratchet having a plurality of teeth and said second coupling member comprises a pawl, the spacing between adjacent teeth of said ratchet being substantially equal to the spacing between adjacent teeth of said keeper.

13. A patterning device as recited in claim 12 wherein said pattern control means comprises means for generating electrical pulses, a solenoid adapted upon energization to force said pawl into engagement with said ratchet, electrical circuit means controlled by said pulses for energizing said solenoid, and means for synchronizing said pulses with the rotation of said shaft to engage said pawl and ratchet while said locking member is in locking engagement with said keeper.

14. A patterning device as recited in claim 13 wherein said means for synchronizing said pulses comprises a disk mounted on said shaft, said disk having a radially extending circumferential slot, a discontinuity probe fixedly located proximate to said disk within the radial location of said slot for providing an electrical signal each time the slot passes the probe and means connecting said electrical signal into said electrical circuit means.

15. A patterning device for a tufting machine having a plurality of reciprocating needles disposed laterally across the machine and adapted to penetrate a backing fabric moving longitudinally of the machine to insert a plurality of stitches upon each penetration of the backing fabric, and shiftable means including a drive bar for providing relative lateral movement between the needles and the backing fabric, said patterning device comprising: a housing, a drive shaft rotatably journalled in said housing, means for rotating said shaft in timed relationship with the reciprocation of said needles, means defining guideways within said housing, first and second carriage members slidably mounted on said guideways, first and second cams fixed for rotation on said shaft for respectively driving said first and second carriages in first and second opposing directions toward and away from each other, said carriages moving in said first directions when said needles are free of the backing fabric, an output member slidably supported within said housing, first and second ratchet members and a keeper member carried by said output member, means for supporting a pawl on each carriage in juxtaposition with a respective ratchet and for urging said pawls away from engagement with said ratchets, said pawls and ratchets being disposed such that driving engagement may occur only when the carriage is moving in said first direction, pattern control means for forcing one of said pawls selectively into engagement with the respective ratchet for coupling said output member to the respective carriage, a locking tooth journalled in said housing for engagement with said keeper for securing said output member, a third cam fixed for rotation on said shaft for forcing said locking tooth into locking engagement with said keeper just after movement of said carriage in said first direction and for releasing said keeper just prior to movement of said carriages in said first direction, and means for connecting said output member to said drive bar.

16. A patterning device as recited in claim 15 wherein said keeper member comprises a plurality of spaced teeth, said locking tooth being wedged between adjacent keeper teeth after each movement of said carriage in said first direction, the spacing between adjacent keeper teeth being substantially equal to the spacing between adjacent ratchet teeth.

17. A patterning device as recited in claim 16 wherein said third cam releases the locking tooth from wedging engagement with a first set of keeper teeth to provide a clearance between said tooth and said first set of teeth while maintaining said tooth between said first set of teeth during a portion of the movement of said carriages in the first direction, and thereafter frees said locking tooth from between said first set of teeth during a subsequent smaller portion of said movement of the carriages, and thereafter inserts said tooth between an adjacent set of keeper teeth while the carriages continue a final portion said movement with a coupled pawl and ratchet.

18. A patterning device was recited in claim 15 wherein said pattern control means comprises means for generating electrical pulses, a solenoid adapted upon energization to force said pawl into engagement with said ratchet, electrical circuit means controlled by said pulses for energizing said solenoid, and means for synchronizing said pulses with the rotation of said shaft to engage said pawl and ratchet while said locking tooth is in locking engagement with said keeper.

19. A patterning device as recited in claim 18 wherein said means for synchronizing said pulses comprises a disk mounted on said shaft, said disk having a radially extending circumferential slot, a discontinuity probe fixedly located proximate to said disk within the radial location of said slot for providing an electricl signal each time the slot passes the probe and means for connecting said electrical signal into said electrical circuit means.

20. A patterning device as recited in claim 18 including an electrical inhibitor circuit means for preventing one solenoid from being energized while the other solenoid is energized.

21. A patterning device as recited in claim 15 including means selectively controlled by said pattern control means for preventing coupling of the output member to the carriage and for further preventing releasing of said locking tooth from said keeper member.

* * * * *